US005956863A

United States Patent [19]

Allen

[11] Patent Number: 5,956,863

[45] Date of Patent: Sep. 28, 1999

[54] HAIR DRYER APPARATUS AND METHOD

[76] Inventor: Donavan J. Allen, 101 Cason St., Taylors, S.C. 29687

[21] Appl. No.: 09/227,376

[22] Filed: Jan. 8, 1999

[51] Int. Cl.[6] ..... A45D 20/08

[52] U.S. Cl. ..... 34/97; 34/96

[58] Field of Search ..... 34/96, 97; 219/222; 392/380, 383, 384

[56] References Cited

U.S. PATENT DOCUMENTS

| | | |
|---|---|---|
| 648,263 | 4/1900 | Hull . |
| 1,284,139 | 11/1918 | Ponic . |
| 1,408,521 | 3/1922 | Lathrop . |
| 1,829,831 | 11/1931 | Hiskey . |
| 1,942,905 | 1/1934 | Semkow . |
| 1,948,807 | 2/1934 | Taylor . |
| 2,306,100 | 12/1942 | Williams . |
| 2,456,703 | 12/1948 | Hatchette . |
| 2,824,323 | 2/1958 | Tos et al. . |
| 2,856,700 | 10/1958 | Wales . |
| 2,985,178 | 5/1961 | Christensen, Jr. . |
| 3,027,355 | 3/1962 | Taul et al. . |
| 3,322,347 | 5/1967 | Pierce . |
| 3,373,740 | 3/1968 | Riepl . |
| 3,568,934 | 3/1971 | Dunn . |
| 3,692,024 | 9/1972 | Von Otto . |
| 3,717,936 | 2/1973 | Tolmie et al. . |
| 3,721,252 | 3/1973 | Ayella . |
| 3,731,697 | 5/1973 | Yost . |
| 3,861,060 | 1/1975 | McNair . |
| 4,324,018 | 4/1982 | Olsson . |
| 4,508,465 | 4/1985 | Orton . |
| 4,509,545 | 4/1985 | Trotter . |
| 4,602,146 | 7/1986 | Barnes et al. ..... 34/96 |
| 4,610,851 | 9/1986 | Colvert et al. . |
| 4,709,717 | 12/1987 | Rannigan et al. . |
| 4,758,154 | 7/1988 | Branders . |
| 4,836,702 | 6/1989 | Allen . |
| 4,928,402 | 5/1990 | Allen . |
| 4,991,314 | 2/1991 | Allen . |
| 5,297,739 | 3/1994 | Allen . |
| 5,344,314 | 9/1994 | Zagoroff et al. ..... 432/222 |

FOREIGN PATENT DOCUMENTS

| | | |
|---|---|---|
| 742381 | 3/1933 | France . |
| 818244 | 9/1937 | France . |
| 950020 | 9/1956 | Germany . |
| 924139 | 4/1963 | United Kingdom . |

*Primary Examiner*—Henry Bennett
*Assistant Examiner*—Pamela A. Wilson
*Attorney, Agent, or Firm*—Dority & Manning, P.A.

[57] ABSTRACT

An apparatus and method of drying hair in which an axial flow of heated air is diverged from the axis toward a circular array of flow nozzles at a selected flow velocity. The nozzles direct the heated air along a conical flow pattern such that the air is focused to a common point. When the circular array is positioned such that a hair-carrying surface, e.g., the scalp of a user, is located between the circular array and the common point, hair will be lifted to provide enhanced drying conditions. The circular array is located on a nozzle structure which may be integral with the housing of a hand-held hair dryer, or configured as a separable attachment.

28 Claims, 5 Drawing Sheets

HAIR DRYER APPARATUS AND METHOD

BACKGROUND OF THE INVENTION

The present invention relates generally to the art of hand-held hair dryers and the like. More particularly, the present invention relates to hair dryers of the type which focus the forced air to a common point for enhanced drying conditions.

Hand-held hair dryers have been provided in a variety of configurations. Typically, such hair dryers are constructed having a housing defining an air intake and an air outlet. An electric motor is provided to drive an internal fan, which draws air from the ambient environment into the air intake. The air is forced across a heating element toward the air outlet. Often, the housing will include a lateral handle such that the overall device has a "gun-like" configuration.

The heated air will often pass directly from the air outlet of the housing, thereby assuming a generally columnar flow pattern as it exits. In some cases, diffusers or other such accessories may be situated on the end of the dryer housing to alter the flow pattern of the heated air. Conventional flow patterns, however, have generally tended to flatten hair against the surface of the scalp during use. The heated air encounters difficulty in getting under the flattened hair, thus prolonging the drying process.

In prior work, the present inventor has developed methods and apparatus for drying hair which overcome certain deficiencies of conventional approaches. In this regard, U.S. Pat. No. 5,297,739, incorporated herein by reference, illustrates an embodiment of a hair dryer apparatus in which a circular array of nozzles is situated about a toroidal tube. The nozzles are angled such that heated air will be focussed toward a common point ahead of the array. When the dryer is positioned such that the scalp is between this common point and the circular array, hair will be lifted and agitated so as to provide enhanced drying conditions.

SUMMARY OF THE INVENTION

The present invention recognizes and addresses various disadvantages of prior art constructions and methods. Accordingly, it is an object of the present invention to provide novel structures for a hair dryer apparatus.

It is a further object of the present invention to provide a novel hair dryer of the type which focus forced air to a common point for enhanced drying conditions.

It is a specific object of the present invention to provide a novel arrangement wherein a nozzle structure having an array of flow orifices is located on the end of a dryer housing.

It is also an object of the present invention to provide a novel flow adapter for a hair dryer apparatus.

It is also an object of the present invention to provide novel methodology of drying hair.

It is a further object of the present invention to provide a drying apparatus for use in conjunction with a source of pressurized fluid.

Some of these objects are achieved by a hair dryer apparatus comprising a housing defining an air intake and further defining a flow path therethrough. A fan, located in the housing, is operative to draw air into the air intake and force the air along the flow path defined by the housing. A nozzle structure is located on the housing in fluid communication with the flow path, and includes an array of flow orifices. The array of flow orifices is located on a face of the nozzle structure and is situated about an axis. In addition, the nozzle structure is configured such that air forced into the nozzle structure is directed toward the array of flow orifices. The array of flow orifices is configured to focus air passing therethrough towards a common point axially spaced from the face of the nozzle structure by a predetermined distance.

In exemplary embodiments, the nozzle structure is constructed having an inverted conical portion configured to diverge forced air toward the circular array of orifices. Often, the nozzle structure will define at least one air return passage extending between an inner surface of the inverted conical portion and an outer surface of the nozzle structure. For example, the air return passage may extend obliquely with respect to a centerline of the nozzle structure. Preferably, the nozzle structure may comprise at least three of such air return passages.

Often, the housing may be configured having a first tubular portion defining the flow path along which air flows to the nozzle structure, and a second handle portion extending laterally from the tubular portion such that the housing has a gun-like configuration. In some cases, the nozzle structure may be integral with the housing. In other cases, the nozzle structure may be removably connected to the housing.

Other objects of the present invention are achieved by a hair dryer apparatus comprising a housing defining a tubular air conduit defining a flow path therethrough. An air flow mechanism is operative to move forced air along the tubular air conduit. A nozzle structure, located at an end of the housing, includes a circular array of flow orifices. The nozzle structure is configured having an inverted conical portion to direct forced air introduced into the nozzle structure toward the circular array of flow orifices. The circular array of flow orifices is configured such that air passing therethrough will collectively follow a conical pattern. Preferably, individual flow orifices of the circular array may be formed by a respective cylindrical nozzle.

Still further objects of the present invention are achieved by a hair dryer apparatus for drying hair located on a hair-carrying surface. The apparatus comprises a source of forced air. A nozzle structure is located in fluid communication with the source of forced air. The nozzle structure includes an inverted conical portion having a circular array of flow orifices located about a base thereof such that forced air flowing past an apex of the inverted conical portion will be diverted toward the circular array of flow orifices. Respective flow orifices of the circular array are configured such that forced air passing therethrough will collectively follow a conical pattern toward a common point ahead of the nozzle structure.

In exemplary embodiments, the source of forced air is operative to provide the forced air under sufficient pressure such that the forced air will be reflected back toward the nozzle structure when the hair-carrying surface is located between an end face of the nozzle structure and the common point. Preferably, the nozzle structure will define a plurality of air return passages extending obliquely with respect to a centerline axis of the inverted conical portion between an inner surface of the inverted conical portion and an outer surface of the nozzle structure.

Often, individual flow orifices of the circular array may be formed by a respective cylindrical nozzle. Moreover, the flow orifices may be angled such that the common point will be located in a range of approximately 2–12 inches ahead of the circular array.

Additional objects of the present invention are achieved by a flow adapter for use with a hand-held hair dryer device.

The adapter comprises a body having a fluid opening at a first axial end thereof and a circular array of flow orifices at a second axial end thereof. The body further defines an internal flow cavity between the fluid opening and the circular array. The body is configured to define an inverted conical portion having a base located adjacent to the circular array.

The inverted conical portion integrally extends to an apex situated at a third axial location spaced from the second axial location in a direction toward the first axial location. At least one air return passage is also defined by the body. The air return passage extends obliquely with respect to a centerline axis of the inverted conical portion between an inner surface of the inverted conical portion and an outer surface of the body.

In exemplary embodiments, the circular array of flow orifices is configured to focus air passing therethrough towards a common point located a predetermined distance from the second axial location in a direction away from the first axial location. Preferably, each of the cylindrical nozzles may be oriented at an angle falling within a range of approximately 10 degrees to 45 degrees with respect to the centerline axis. For example, the angle may be approximately 15 degrees in some exemplary embodiments.

Still further objects of the present invention are achieved by a method of drying hair located on a hair-carrying surface. One step of the method involves providing a flow-directing body having an array of flow orifices located adjacent a base of an inverted conical portion. The inverted conical portion of the body defines an apex along a centerline axis thereof. Individual flow orifices in the array are angled toward a common point ahead of the flow-directing body along the centerline axis.

An additional step of the method involves introducing heated air into the flow-directing body at a selected pressure such that the heated air is diverged from the centerline axis by the inverted conical portion and passes through the array of flow orifices toward the common point. As a further step, the hair-carrying surface is situated at a location between the common point and the flow-directing body such that heated air from the flow orifices reflects off of the hair-carrying surface and back toward the flow-directing body.

Other objects of the present invention are achieved by a dryer apparatus comprising a source of pressurized fluid. A nozzle structure is provided in fluid communication with the source of pressurized fluid. The nozzle structure includes an inverted conical portion having a circular array of cylindrical flow nozzles located about a base thereof such that fluid flowing past an apex of the inverted conical portion will be diverted toward the circular array of flow nozzles. Respective flow nozzles of the circular array are configured such that fluid passing therethrough will collectively follow a conical pattern toward a common point ahead of the nozzle structure.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
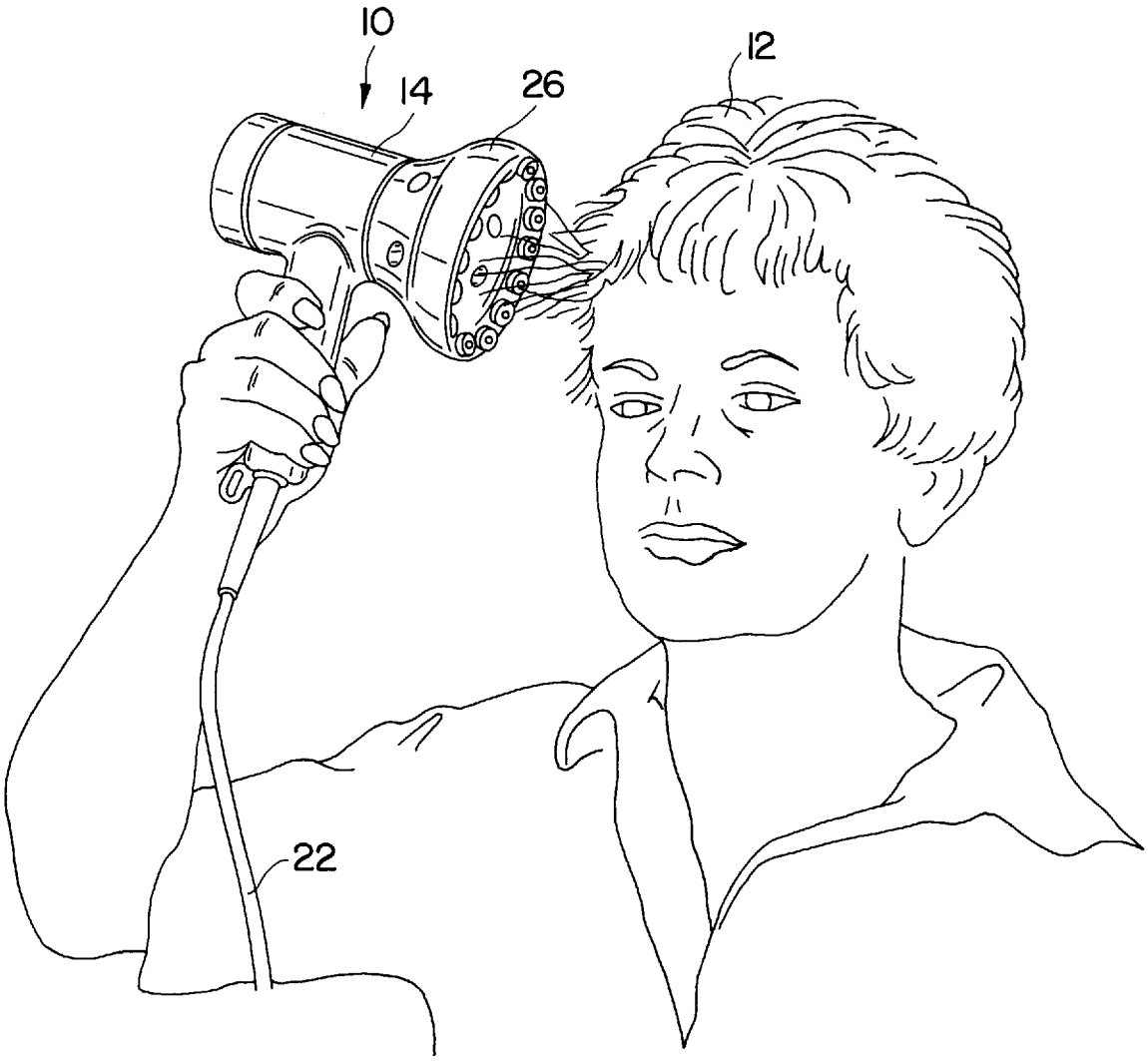
FIG. 1 is an illustration of a hair dryer device of the present invention as it may appear in use.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates a hair dryer 10 of the present invention being used to dry the hair 12 of a user. As will be explained in more detail below, dryer 10 is configured to provide a focussed cone of forced air that lifts the individual hair strands. Forced air will circulate near the scalp, to thereby facilitate drying of the hair.

Figure 2:
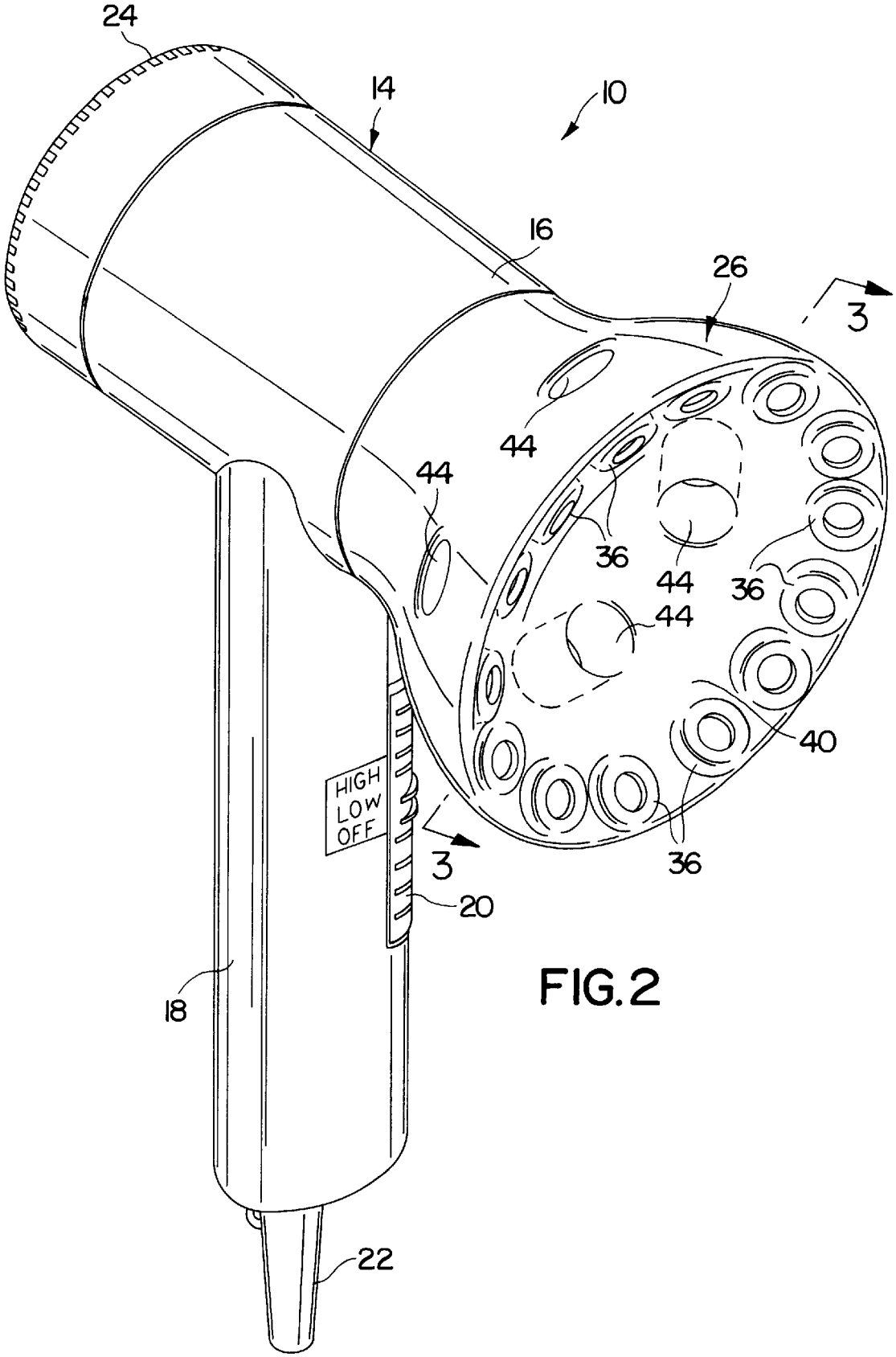
FIG. 2 is a perspective view of the exemplary hair dryer device shown in FIG. 1.

As can be seen with reference to FIG. 2, dryer 10 includes a housing 14 having a tubular main portion 16 and a handle portion 18. Handle portion 18 extends from main portion 16 in a generally lateral direction such that housing 14 has a gun-like configuration. A switch 20 may located on handle portion 18 or at another appropriate location to control operation of dryer 10 in one or more operating speeds. The heater and motor internal to housing 14 are electrically connected with a source of AC power by a power cord 22.

Housing 14 defines both an intake into which ambient air is drawn and an outlet through which the air is forced under pressure after being heated. In the illustrated embodiment, the air intake is defined at one axial end of tubular main portion 16, as indicated at 24. A nozzle structure 26 is located at the air outlet to direct the otherwise columnar flow of forced air into a conical flow pattern, as desired.

Figure 3:
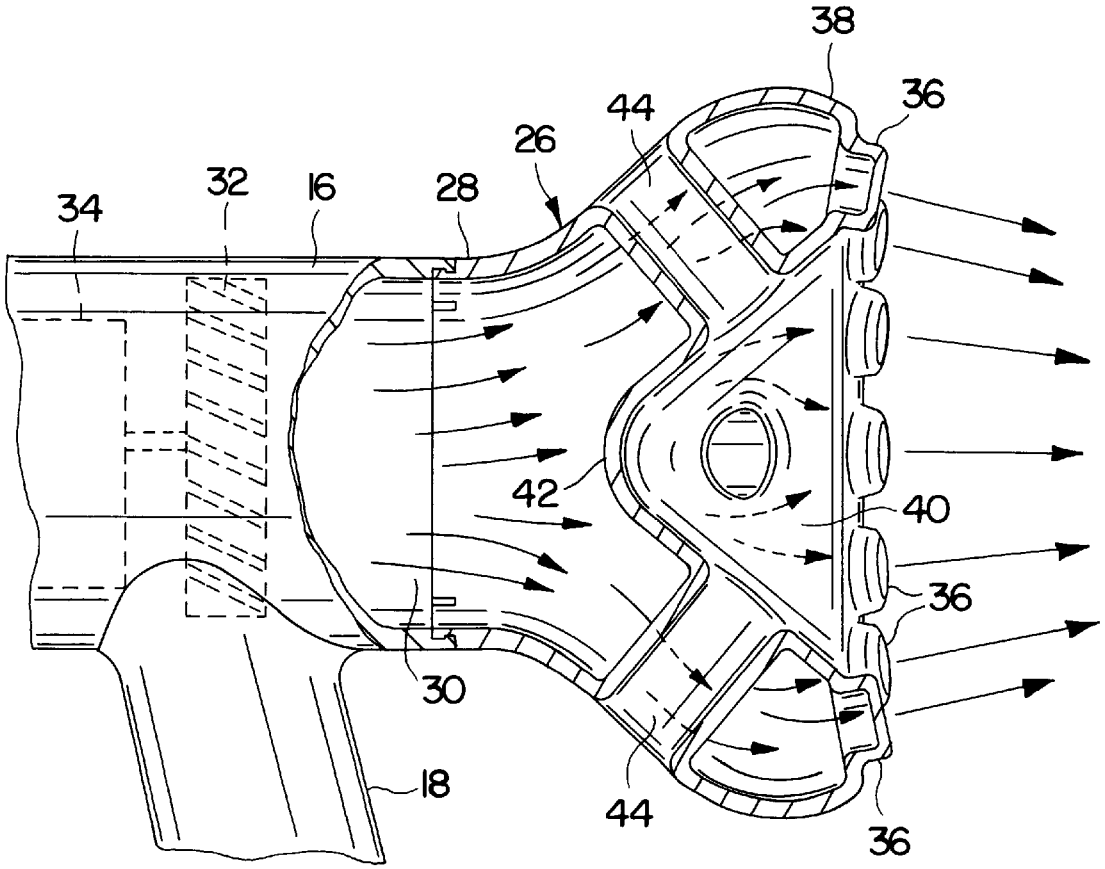
FIG. 3 is a partial cross-sectional view taken along line 3—3 of FIG. 2 showing an interior of the nozzle structure.

Referring now also to FIG. 3, nozzle structure 26 is configured as a separable flow adapter that may be attached to housing 14 when its use is desired. Toward this end, one axial end 28 of nozzle structure 26 is attached to tubular main portion 16 of housing 14. In many preferred embodiments, nozzle structure 26 may be configured having compliant fingers which extend into the bore of main portion 16. The compliant fingers engage a groove or other dedicated structure defined in the housing bore to lock nozzle structure 26 in position. The compliant fingers may be depressed by the user when it is desired to remove nozzle structure 26.

When nozzle structure 26 is attached to the dryer housing as shown in FIG. 3, forced air flowing from the air outlet 30 of main portion 16 will be directed into the interior of nozzle structure 26. As noted above, the air is forced by operation of a fan element driven by a suitable motor (diagrammatically indicated at 32 and 34, respectively). Typically, a heating element will also be placed in main portion 16 to heat the air as it is forced therethrough.

A plurality of flow orifices, here in the form of respective cylindrical nozzles 36, are located at the opposite axial end 38 of nozzle structure 26. In the illustrated embodiment, nozzles 36 are situated in a circular array spaced radially about a centerline axis, at predetermined angular positions. Nozzle structure 26 further defines an inverted conical portion 40, the base of which is adjacent to the circular array of nozzles 36. The apex 42 of inverted conical portion 40 is located along the centerline axis at a position between the axial ends of nozzle structure 26.

A plurality of air return passages 44 extend between the inner surface of inverted conical portion 40 and the outer surface of nozzle structure 26. In the illustrated embodiment, four such passages 44 are located at 90° intervals about the centerline axis. As shown, passages 44 may be oriented obliquely with respect to the centerline axis in many preferred embodiments.

It can be seen in FIG. 3 that air forced into the interior of nozzle structure 26 will be diverged toward nozzles 36 by the shape of inverted conical portion 40. The air will then pass through nozzles 36, which are slightly angled so that the exiting air will follow the desired conical path. Because the air travels axially through nozzle structure 26 as shown, the slight diversions in the flow path that occur inside of nozzle structure 26 will have a relatively small affect on flow velocity.

Figure 4:
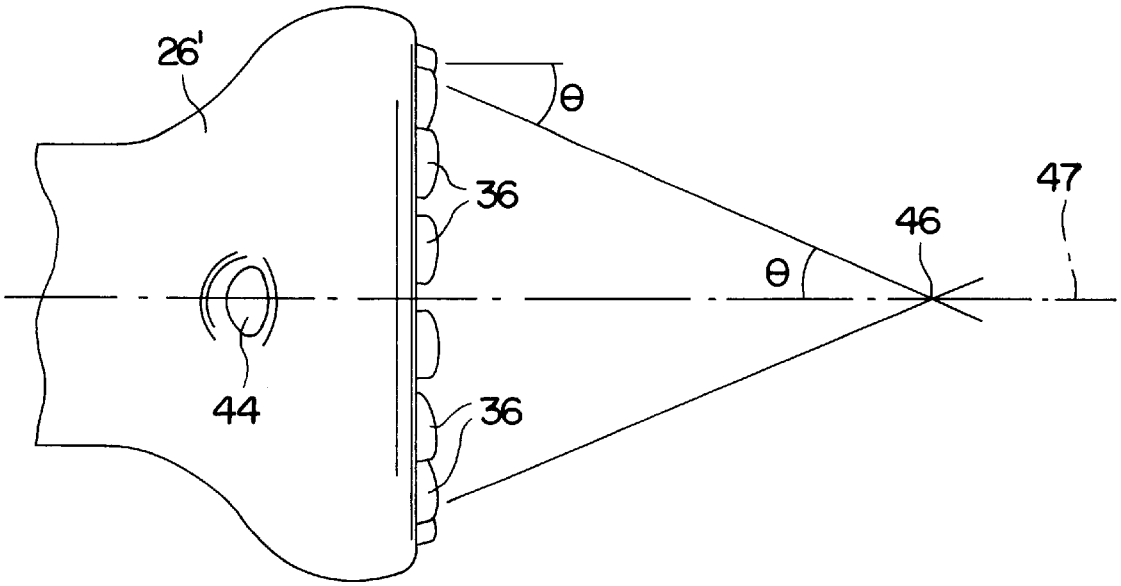
FIG. 4 is a diagrammatic representation of the external flow pattern produced by the nozzle structure.

Certain aspects of the present invention can be most easily explained with reference to FIG. 4. In this case, an alternative nozzle structure 26' is illustrated which is preferably identical in most respects to nozzle structure 26. In contrast to nozzle structure 26, however, nozzle structure 26' is formed as an integral extension of the main housing such that it is not easily removable in the manner of nozzle structure 26.

As can be seen, nozzles 36 function to focus the forced air towards a common point 46 located ahead of nozzle structure 26 (or 26') along centerline axis 47. In exemplary embodiments, point 46 may be displaced from the end face of the nozzle structure by an axial distance falling in range of a range of approximately 2–12 inches. In one especially preferred construction, this axial distance will be about 7–8 inches. In view of these parameters, the angle θ at which nozzles 36 are directed will generally fall within a range of approximately 10 degrees to 45 degrees, with an angle of approximately 15 degrees being particularly preferred.

Figure 5A:
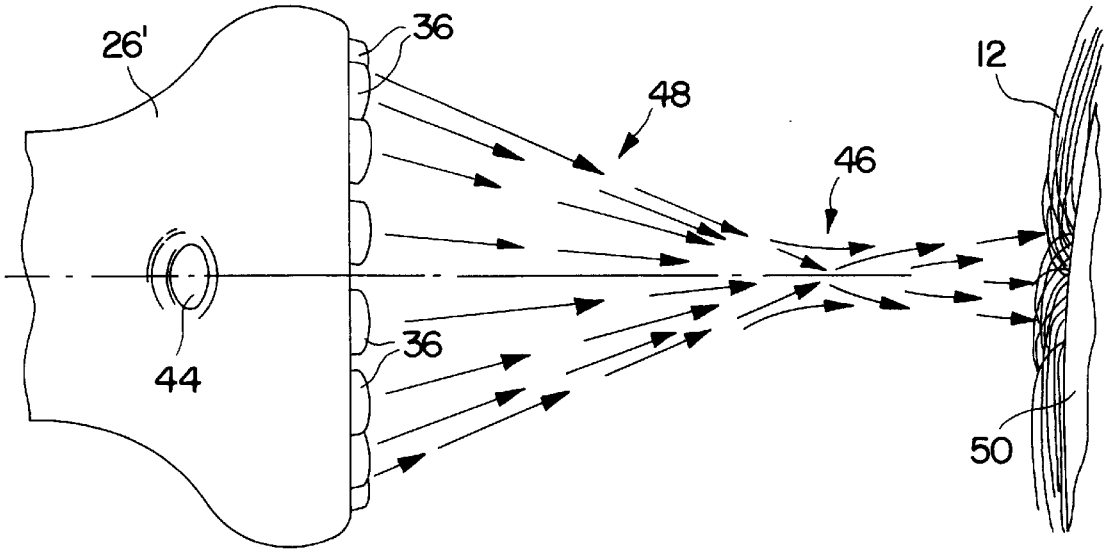
FIGS. 5A and 5B are views similar to FIG. 4 illustrating the hair lifting effect that may be achieved with use of the present invention.
Figure 5B:
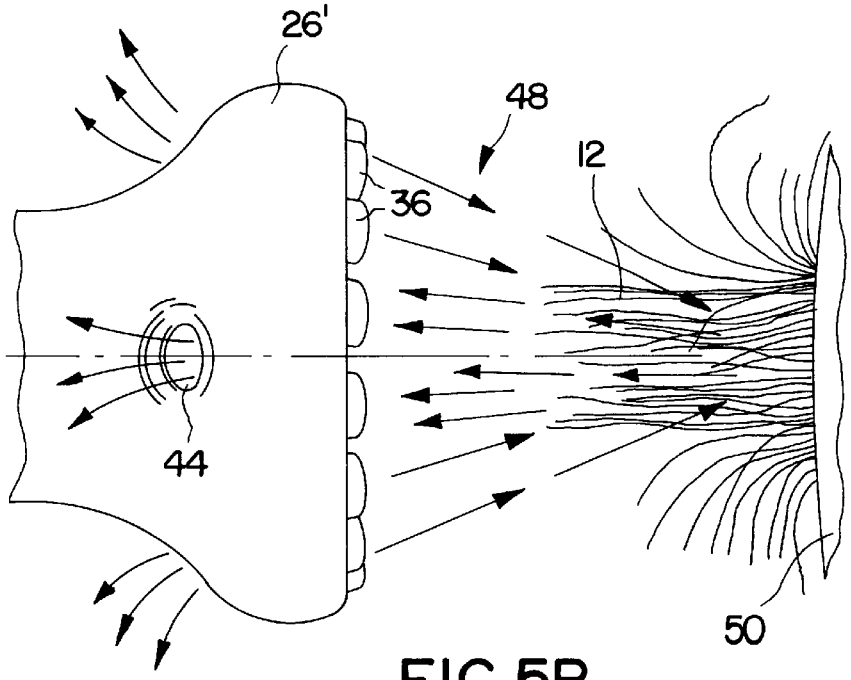

Operation of the illustrated hair dryer can be most easily explained with reference to FIGS. 5A and 5B. As indicated at 48, the nozzle structure 26 (or 26') creates a focussed cone of forced air. As one skilled in the art will recognize, the forced air will begin to diverge after reaching a degree of convergence at common point 46. Forced air impinging the scalp 50 of a user will tend to scatter in lateral directions if the scalp is located past common point 46. Thus, as shown in FIG. 5A, the air will form somewhat of a barrier and hair 12 will tend to remain flattened against the scalp.

When scalp 50 is moved to a location between common point 46 and the end face of nozzle structure 26 (or 26'), the forced air will tend to reflect axially back towards the nozzle structure. The reflected air will tend to entrain strands of hair, thereby lifting the hair off the scalp. As a result, air will be able to more easily circulate around the base of the hair strands. In addition, the reflected air will cause significant agitation of the entrained hair to further facilitate drying. As shown, much of the reflected air will continue back through the opening defined in the plane of the circular array, and then through air passages 44.

Figure 6:
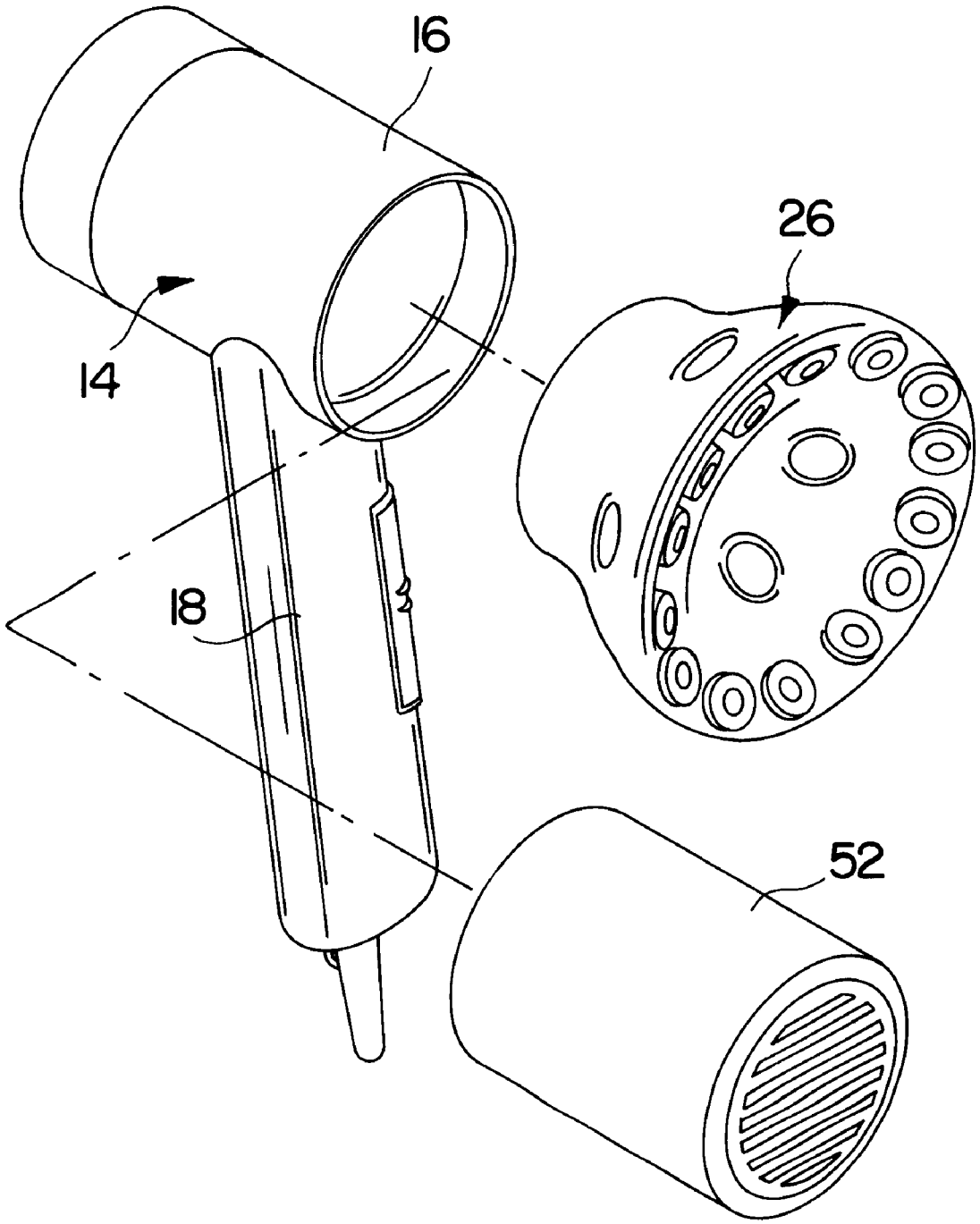
FIG. 6 illustrates the manner in which a removable nozzle structure may be substituted for another accessory configured for attachment to the dryer housing.

Particularly in hair salons and other professional settings, it may often be desirable to replace nozzle structure 26 with another accessory when drying is complete. Thus, FIG. 6 illustrates removal of nozzle structure 26 from the tubular main portion 16 of housing 14. An alternative attachment, such as that indicated at 52, may then be substituted for nozzle structure 26.

It can be seen that the present invention provides apparatus and methodology in furtherance of the above objects. While preferred embodiments of the invention have been shown and described, modifications and variations may be made thereto by those of ordinary skill in the art without departing from the spirit and scope of the present invention. For example, it will be appreciated that many teachings of the present invention will often be applicable to fluids in general, in addition to air.

In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A hair dryer apparatus comprising:

a housing defining an air intake and further defining a flow path therethrough;

a fan located in said housing, said fan being operative to draw air into said air intake and force the air along said flow path;

a nozzle structure located on said housing in fluid communication with the flow path, said nozzle structure including an array of flow orifices located on a face thereof and being situated about an axis;

said nozzle structure being configured to define a flow path such that air forced into said nozzle structure is directed toward said array of flow orifices; and said array of flow orifices being configured to focus air passing therethrough towards a common point axially spaced from said face of said nozzle structure by a predetermined distance.

2. A hair dryer apparatus as set forth in claim 1, wherein said nozzle structure is configured having an inverted conical portion configured to diverge forced air toward said circular array of orifices.

3. A hair dryer apparatus as set forth in claim 2, wherein said nozzle structure defines at least one air return passage extending between an inner surface of said inverted conical portion and an outer surface of said nozzle structure.

4. A hair dryer apparatus as set forth in claim 3, wherein said nozzle structure comprises at least three of said air return passages.

5. A hair dryer apparatus as set forth in claim 4, wherein said at least one air return passage extends obliquely with respect to a centerline axis of said nozzle structure.

6. A hair dryer apparatus as set forth in claim 1, wherein said nozzle structure defines at least one air return passage extending therethrough for passage of reflected air.

7. A hair dryer apparatus as set forth in claim 1, wherein said nozzle structure is integral with said housing.

8. A hair dryer apparatus as set forth in claim 1, wherein said nozzle structure is removably connected to said housing.

9. A hair dryer apparatus as set forth in claim 1, wherein said housing has a first tubular portion defining said flow path along which air flows to said nozzle structure, and a second handle portion extending laterally from said tubular portion such that said housing has a gun-like configuration.

10. A hair dryer apparatus comprising:

a housing defining a tubular air conduit forming a flow path therethrough;

an air flow mechanism operative to move forced air along said tubular air conduit;

a nozzle structure located at an end of said housing, said nozzle structure including a circular array of flow orifices;

said nozzle structure being configured having an inverted conical portion to direct the forced air introduced into said nozzle structure toward said circular array of flow orifices; and said circular array of flow orifices being configured such that air passing therethrough will collectively follow a conical pattern.

11. A hair dryer apparatus as set forth in claim 10, wherein said nozzle structure defines at least one air return passage extending between an inner surface of said inverted conical portion and an outer surface of said nozzle structure.

12. A hair dryer apparatus as set forth in claim 11, wherein said nozzle structure comprises a total of four of said air return passages extending obliquely with respect to a centerline axis of said nozzle structure.

13. A hair dryer apparatus as set forth in claim 10, wherein said nozzle structure is integral with said housing.

14. A hair dryer apparatus as set forth in claim 10, wherein said nozzle structure is removably connected to said housing.

15. A hair dryer apparatus as set forth in claim 10, wherein individual flow orifices of said circular array are formed by a respective cylindrical nozzle.

16. A hair dryer apparatus as set forth in claim 15, wherein said flow orifices are angled such that said common point will be located in a range of approximately 2–12 inches ahead of said circular array.

17. A hair dryer apparatus for drying hair located on a hair-carrying surface, said apparatus comprising:

a source of forced air;

a nozzle structure in fluid communication with said source of forced air, said nozzle structure including an inverted conical portion having a circular array of flow orifices located about a base thereof such that forced air flowing past an apex of said inverted conical portion will be diverted toward said circular array of flow orifices; and respective flow orifices of said circular array being configured such that forced air passing therethrough will collectively follow a conical pattern toward a common point ahead of said nozzle structure.

18. A hair dryer apparatus as set forth in claim 17, wherein said source of forced air is operative to provide the forced air under sufficient pressure such that the forced air will be reflected back toward said nozzle structure when the hair-carrying surface is located between an end face of said nozzle structure.

19. A hair dryer apparatus as set forth in claim 18, wherein said nozzle structure defines a plurality of air return passages extending obliquely with respect to a centerline axis of said inverted conical portion between an inner surface of said inverted conical portion and an outer surface of said nozzle structure.

20. A hair dryer apparatus as set forth in claim 19, wherein individual flow orifices of said circular array are formed by a respective cylindrical nozzle.

21. A flow adapter for use with a hand-held hair dryer device, said adapter comprising:

a body having a fluid opening at a first axial end thereof and a circular array of flow orifices at a second axial end thereof, said body further defining an internal flow cavity between said fluid opening and said circular array;

said body configured to define an inverted conical portion having a base located adjacent to said circular array, said inverted conical portion integrally extending to an apex situated at a third axial location spaced from said second axial location in a direction toward said first axial location; and at least one air return passage being defined by said body, said air return passage extending obliquely with respect to a centerline axis of said inverted conical portion between an inner surface of said inverted conical portion and an outer surface of said body.

22. A flow adapter as set forth in claim 21, wherein said circular array of flow orifices is configured to focus air passing therethrough towards a common point located a predetermined distance from said second axial location in a direction away from said first axial location.

23. A flow adapter as set forth in claim 22, wherein individual flow orifices of said circular array are formed by a respective cylindrical nozzle.

24. A flow adapter as set forth in claim 23, wherein each of said cylindrical nozzles is oriented at an angle falling within a range of approximately 10 degrees to 45 degrees with respect to said centerline axis.

25. A flow adapter as set forth in claim 24, wherein said angle is approximately 15 degrees.

26. A method of drying hair located on a hair-carrying surface, said method comprising steps of:

(a) providing a flow-directing body having an array of flow orifices located adjacent a base of an inverted conical portion, said inverted conical portion defining an apex along a centerline axis thereof, individual flow orifices in said array being angled toward a common point ahead of said flow-directing body along said centerline axis;

(b) introducing heated air into said flow-directing body at a selected pressure such that the heated air is diverged from said centerline axis by said inverted conical portion and passes through said array of flow orifices toward said common point; and (c) situating said hair-carrying surface at a location between said common point and said flow-directing body such that heated air from said flow orifices reflects off of said hair-carrying surface and back toward said flow-directing body.

27. A method of drying hair as set forth in claim 26, wherein said flow-directing body further defines at least one air return passage extending obliquely with respect to said centerline axis such that heated air reflected from said hair-carrying surface will pass back through said air return passage.

28. A dryer apparatus comprising:

a source of pressurized fluid;

a nozzle structure in fluid communication with said source of pressurized fluid, said nozzle structure including an inverted conical portion having a circular array of cylindrical flow nozzles located about a base thereof such that fluid flowing past an apex of said inverted conical portion will be diverted toward said circular array of flow nozzles; and respective flow nozzles of said circular array being configured such that fluid passing therethrough will collectively follow a conical pattern toward a common point ahead of said nozzle structure.

* * * * *